US009393972B2

(12) United States Patent
Minning

(10) Patent No.: US 9,393,972 B2
(45) Date of Patent: Jul. 19, 2016

(54) MODULAR SUPPORT FRAME FOR RAILWAY VEHICLE EQUIPMENT

(71) Applicant: WABTEC HOLDING CORP., Wilmerding, PA (US)

(72) Inventor: Michael J Minning, Simpsonville, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 77 days.

(21) Appl. No.: 13/887,891

(22) Filed: May 6, 2013

(65) Prior Publication Data

US 2013/0299529 A1 Nov. 14, 2013

Related U.S. Application Data

(60) Provisional application No. 61/644,521, filed on May 9, 2012.

(51) Int. Cl.
*B61D 45/00* (2006.01)

(52) U.S. Cl.
CPC ..... *B61D 45/00* (2013.01); *B61D 45/001* (2013.01); *Y10T 29/49826* (2015.01)

(58) Field of Classification Search
CPC ..... B61D 45/00; B61D 45/001; F16M 1/00; F16M 3/00
USPC ..... 224/29.5, 545; 211/26, 26.2, 182, 211/181.1; 322/1; 403/274, 277, 217–218, 403/170–171, 265; 248/637, 674, 676, 678, 248/220, 207, 56, 67; 52/655.1, 653.2
See application file for complete search history.

(56) References Cited

U.S. PATENT DOCUMENTS

| | | | | |
|---|---|---|---|---|
| 2,879,087 | A * | 3/1959 | Haglund | 403/169 |
| 2,970,676 | A | 2/1961 | Maciunas | |
| 3,272,582 | A | 9/1966 | Mack et al. | |
| 3,416,270 | A | 12/1968 | McHugh et al. | |
| 3,734,110 | A * | 5/1973 | Burns | B60R 9/00 135/161 |
| 3,918,850 | A | 11/1975 | Bridigum | |
| 3,955,702 | A | 5/1976 | Lundy | |
| 4,039,133 | A | 8/1977 | Streicher | |
| 4,101,229 | A * | 7/1978 | Weibull | E04B 1/2403 403/171 |
| 4,144,616 | A * | 3/1979 | Gould | H02G 3/083 16/2.1 |
| 4,205,426 | A * | 6/1980 | Stillman, Jr. | 29/512 |

(Continued)

FOREIGN PATENT DOCUMENTS

| | | | |
|---|---|---|---|
| CN | 201206324 | Y | 3/2009 |
| CN | 201262307 | Y | 6/2009 |

(Continued)

*Primary Examiner* — Justin Larson
*Assistant Examiner* — Scott McNurlen
(74) *Attorney, Agent, or Firm* — The Webb Law Firm

(57) ABSTRACT

A modular support frame assembly for attachment to a railway vehicle body is provided. The modular support frame assembly generally includes a support frame comprising a plurality of tubular frame members and a plurality of connecting brackets connecting the tubular frame members to form a three-dimensional structure. The connecting brackets comprise flange elements to accept respective ends of the tubular frame members to form the three-dimensional structure. The ends of the tubular frame members are swaged to the flange elements of the connecting brackets. A mechanical device is supported by the tubular frame members, such as an air compressor driven by a driving motor.

15 Claims, 7 Drawing Sheets

(56) References Cited

U.S. PATENT DOCUMENTS

| | | | | |
|---|---|---|---|---|
| 4,419,937 | A | 12/1983 | Steinmetz et al. | |
| 4,523,683 | A | 6/1985 | Fullenkamp et al. | |
| 4,696,626 | A | 9/1987 | Hata et al. | |
| 4,784,585 | A | 11/1988 | Hata et al. | |
| 5,074,122 | A | 12/1991 | Babin et al. | |
| 5,965,949 | A | 10/1999 | Fukuda et al. | |
| 6,428,127 | B1 | 8/2002 | Rasmussen | |
| 6,758,169 | B2 * | 7/2004 | Suzuki et al. | 123/3 |
| 7,059,841 | B2 * | 6/2006 | Hartl et al. | 417/572 |
| 2004/0057845 | A1 | 3/2004 | Skinner | |
| 2007/0205350 | A1 * | 9/2007 | Shimada et al. | 248/652 |
| 2010/0050560 | A1 | 3/2010 | Werner et al. | |
| 2010/0084387 | A1 * | 4/2010 | Bender et al. | 219/133 |
| 2010/0154118 | A1 | 6/2010 | Pearce | |
| 2011/0050052 | A1 * | 3/2011 | Elkins et al. | 312/223.1 |
| 2011/0204013 | A1 * | 8/2011 | Lahti et al. | 211/85.8 |

FOREIGN PATENT DOCUMENTS

| | | | |
|---|---|---|---|
| CN | 201787288 | U | 4/2011 |
| DE | 10061127 | A1 | 6/2002 |
| EP | 0094297 | A | 11/1983 |
| EP | 0580929 | A1 | 2/1994 |
| EP | 1081439 | A2 | 3/2001 |
| EP | 1445175 | A2 | 8/2004 |
| GB | 854283 | A | 11/1960 |
| JP | 60255569 | A | 12/1985 |
| WO | 9219870 | A | 11/1992 |

* cited by examiner

MODULAR SUPPORT FRAME FOR RAILWAY VEHICLE EQUIPMENT

CROSS REFERENCE TO RELATED APPLICATION

This application claims the benefit of U.S. Provisional Application No. 61/644,521, filed May 9, 2012, and entitled "Modular Support Frame for Railway Vehicle Equipment".

BACKGROUND OF THE INVENTION

1. Field of the Invention

This disclosure relates to support frames for mechanical equipment and, more particularly, support frames for supporting mechanical devices to railway and like vehicles, such air compressors, motors, and like equipment.

2. Description of Related Art

Numerous examples may be found of support or mounting frames for mechanical equipment or other components. U.S. Pat. No. 3,918,850 to Bridigum discloses a mounting frame for resiliently supporting a railway vehicle motor-compressor unit under the vehicle. The frame comprises a single longitudinal member, which connects two tubular end members and an intermediate member. Components, such as an electric motor and/or an air compressor, are mounted to the frame by brackets. U.S. Pat. No. 5,074,122 to Babin et al. discloses an air-conditioning system for a railroad train. The components of the system are disposed within a housing comprised of walls to form a modular unit, which is mounted beneath the floor of a railcar.

U.S. Pat. No. 5,965,949 to Fukuda et al. discloses an engine-driven generator. The components of the generator are disposed within a frame structure comprised of integral upright members and handles, which are jointed by integral support members and side beams fastened to the upright members.

Chinese Utility Model No. CN 201787288 to Li discloses a tube-shaped bracket system for joining structural tube members of a frame. The system includes tubes hingedly connected to each other by fasteners passing through plates extending from the tubes. The structural tube members are placed in the tube and clamped by a fastener.

Chinese Utility Model No. CN 201206324 to Liu et al. discloses a trellis bearing frame wherein structural members of the frame are joined by mutually welding the members to connecting steel loops.

U.S. Pat. No. 3,272,582 to Anderson et al. discloses building components for constructing cabinets, which are made up of struts. The struts are joined by corner members, knuckle joints, and T-shaped members that include legs extending along different axes, which are inserted into the ends of the struts to connect the struts to corner members, knuckle joints, and T-shaped members to each other.

U.S. Patent Application Publication No. 2004/0057845 to Skinner discloses a mounting bracket for a compressor that includes a mounting member and a bracing member, which are connected to each other at their ends by a swaging technique.

SUMMARY OF THE INVENTION

In one embodiment, a support frame structure suitable for supporting an air compressor or similar mechanical equipment is provided. The support frame structure may be a modular unit for mounting to a larger construction, such as a railcar. In one example, the support frame may be fabricated from a plurality of structural members that are joined at their respective ends by corner brackets to which the ends of the structural members are affixed, for example, by swaging.

In another embodiment, a support frame for supporting mechanical devices to a railway vehicle body comprises a plurality of tubular frame members and a plurality of connecting brackets connecting the tubular frame members to form a three-dimensional structure. The connecting brackets comprise flange elements to accept respective ends of the tubular frame members to form the three-dimensional structure. The ends of the tubular frame members are swaged to the flange elements of the connecting brackets.

The connecting brackets may comprise corner brackets to connect the tubular frame members to form a rectangular-shaped three-dimensional structure. The corner brackets at a top side of the rectangular-shaped three-dimensional structure may be adapted for connection to a railway vehicle body. The corner brackets may comprise three generally orthogonal flange elements to connect three tubular frame members to form a corner of the rectangular-shaped three-dimensional structure. The flange elements define receiving openings for the tubular frame members and the ends of the tubular frame members are swaged in place in the openings. The ends of the tubular frame members may be swaged to form end flanges to secure the ends in the openings.

In another embodiment, a modular support frame assembly for attachment to a railway vehicle body is provided. The modular support assembly frame generally comprises a support frame comprising a plurality of tubular frame members and a plurality of connecting brackets connecting the tubular frame members to form a three-dimensional structure. The connecting brackets comprise flange elements to accept respective ends of the tubular frame members to form the three-dimensional structure. The ends of the tubular frame members are swaged to the flange elements of the connecting brackets. A mechanical device is supported by the tubular frame members, such as an air compressor driven by a driving motor.

The connecting brackets may comprise corner brackets to connect the tubular frame members to form a rectangular-shaped three-dimensional structure. The corner brackets at a top side of the rectangular-shaped three-dimensional structure may be adapted for connection to a railway vehicle body. The corner brackets may comprise three generally orthogonal flange elements to connect three tubular frame members to form a corner of the rectangular-shaped three-dimensional structure. The flange elements define receiving openings for the tubular frame members and the ends of the tubular frame members are swaged in place in the openings. The ends of the tubular frame members may be swaged to form end flanges to secure the ends in the openings.

Another embodiment is directed to a method of forming a modular support frame assembly, comprising the steps of: providing a plurality of tubular frame members; connecting the tubular frame members to one another using a plurality of connecting brackets such that the tubular frame members form a three-dimensional structure, the connecting brackets comprising flange elements adapted to accept respective ends of the tubular frame members to form the three-dimensional structure; connecting the respective ends of the tubular frame members to the flange elements; and swaging the ends of the tubular frame members to the flange elements of the connecting brackets.

The method may further comprise supporting a mechanical device between the tubular frame members. The mechanical device may be, for example, an air compressor driven by a driving motor. The connecting brackets may be corner brackets to connect the tubular frame members to form a rectangular-shaped three-dimensional structure. The corner brackets at a top side of the rectangular-shaped three-dimensional structure may be adapted for connection to a railway vehicle body. The corner brackets may comprise three generally orthogonal flange elements to connect three tubular frame members to form a corner of the rectangular-shaped three-dimensional structure. The flange elements may define receiving openings for the tubular frame members, and the method may further comprise swaging the ends of the tubular frame members in place in the openings. The ends of the tubular frame members may be swaged to form end flanges to secure the ends in the openings.

Further details and advantages of the various embodiments detailed herein will become clear upon reviewing the following detailed description of these various embodiments in conjunction with the accompanying drawing figures.

DESCRIPTION OF THE PREFERRED EMBODIMENTS

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

Referring to FIGS. 1-4, a modular support frame assembly 10 generally comprises a composite or modular support frame 100 that is assembled and adapted to support mechanical elements or devices such as an air compressor 20 driven by a drive motor 30. The air compressor 20 and drive motor 30 are depicted as exemplary mechanical equipment that may be supported by the support frame 100 and should not be considered as limiting or exhaustive of the types of mechanical equipment that may be support by the support frame 100. A suitable air compressor 20 and drive motor 30 may be found in U.S. patent application Ser. No. 13/350,980, filed Jan. 16, 2012, and entitled Oil-Free Air Compressor for Rail Vehicles, the disclosure of which is incorporated herein by reference.

Figure 4:
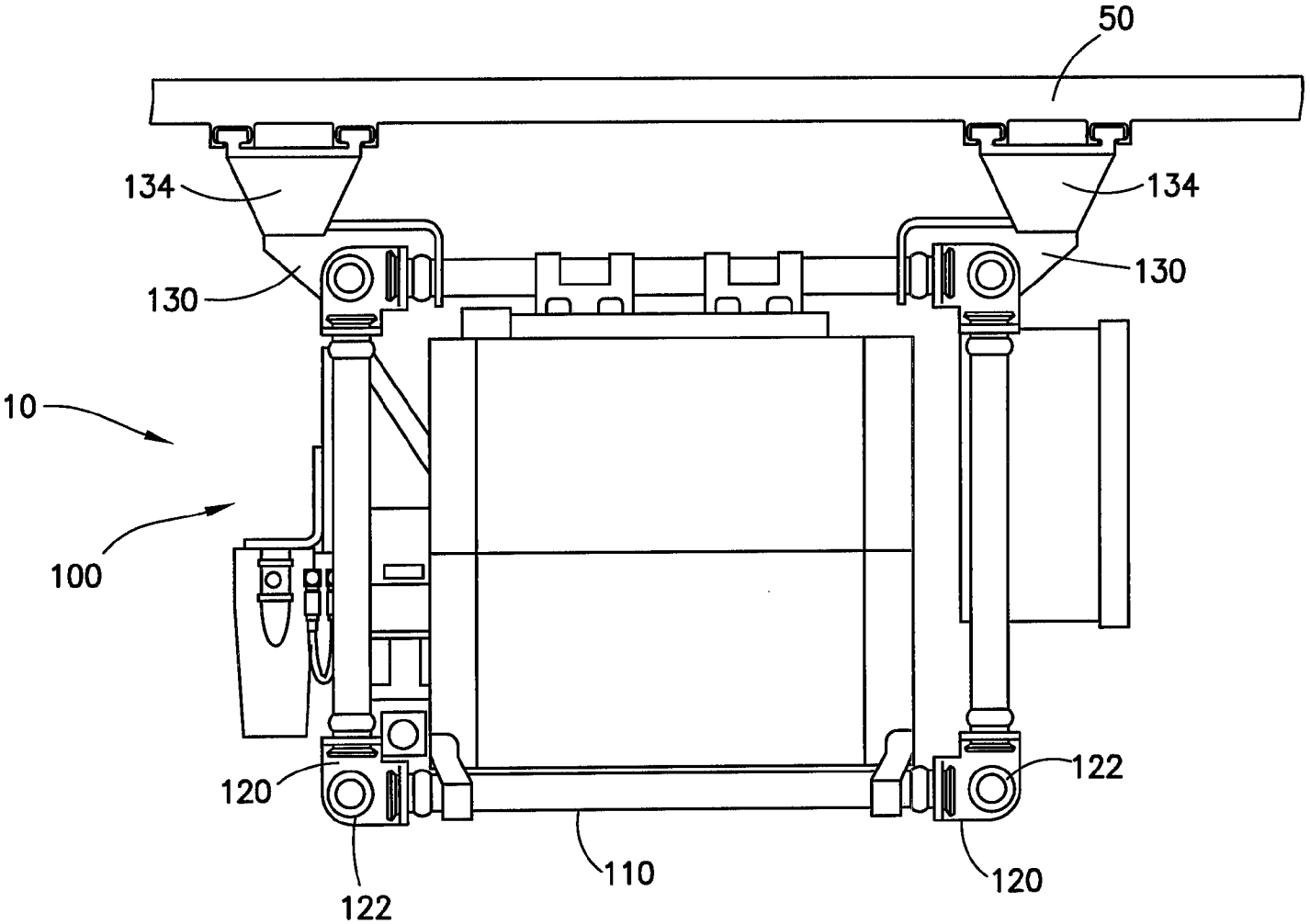
FIG. 4 is an end view of the air compressor and drive motor supported by the modular support frame shown in FIG. 1.
Figure 5:
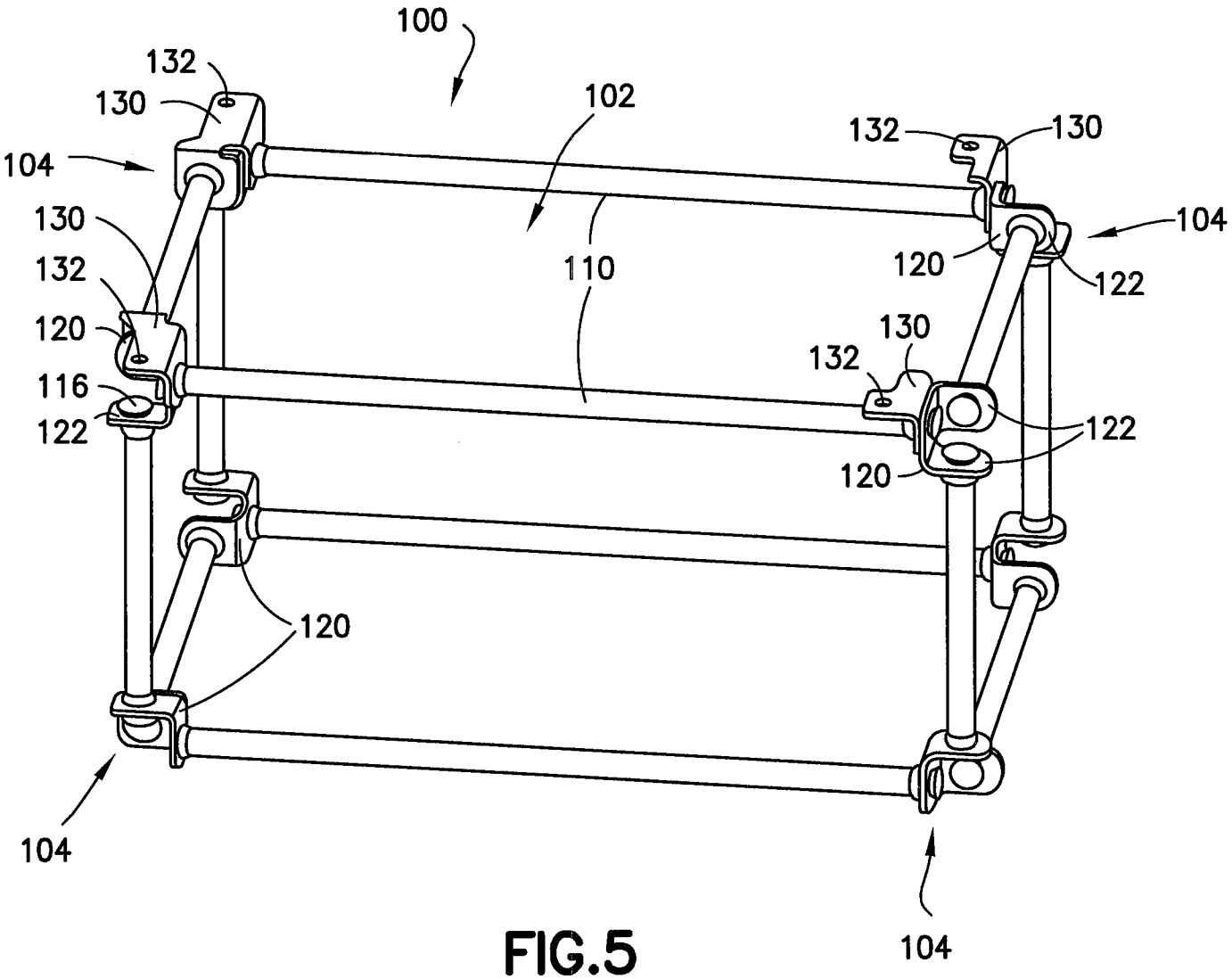
FIG. 5 is an isolation perspective view of the modular support frame shown in FIG. 1.
Figure 6:
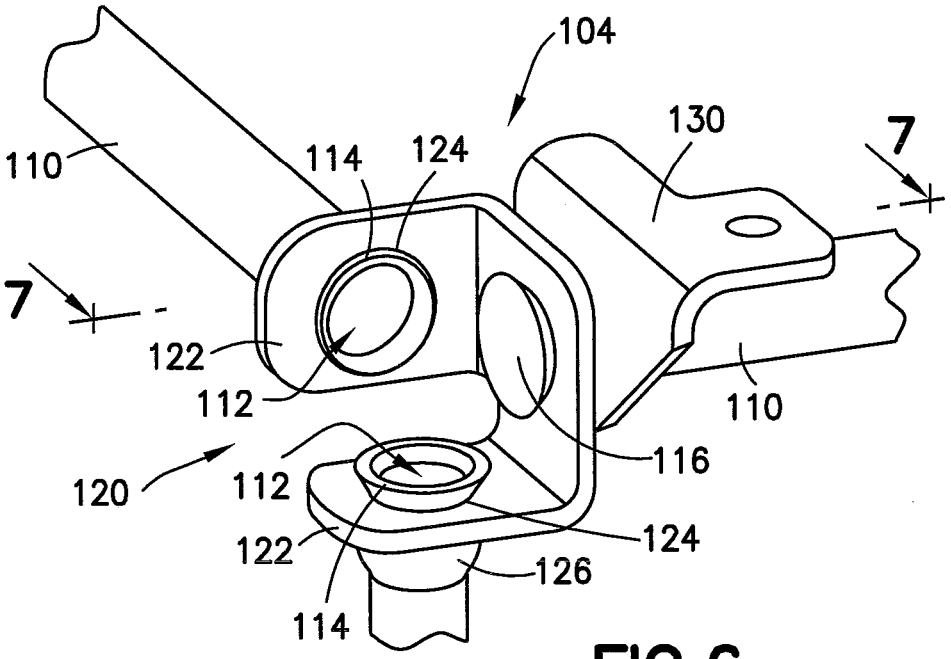
FIG. 6 is a perspective view of a corner bracket used in the modular support frame shown in FIG. 1.
Figure 7:
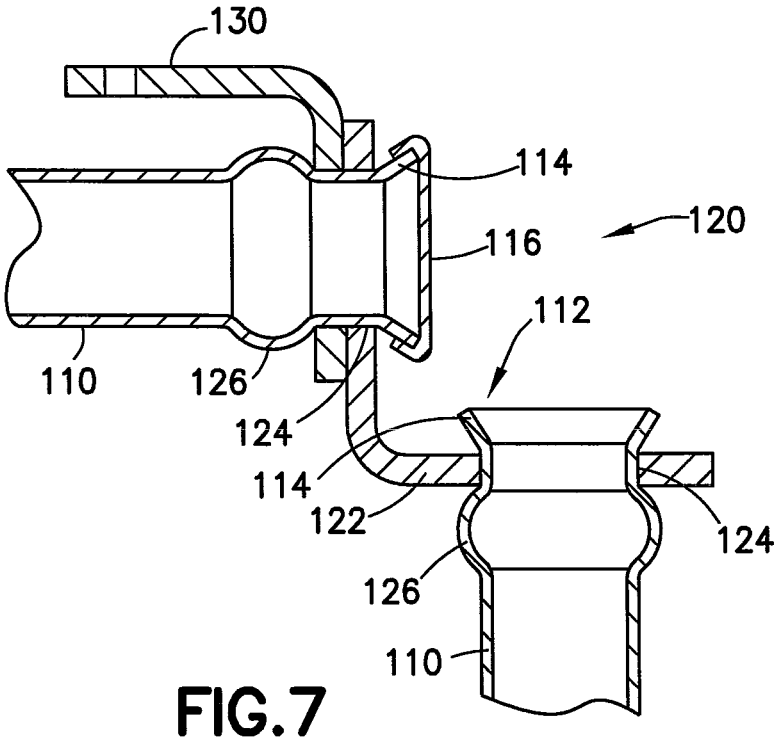
FIG. 7 is a cross-sectional view taken along line 7-7 in FIG. 6 of the corner bracket shown in FIG. 6.

The specifics of the modular support frame 100 (hereinafter "support frame 100") are shown in FIGS. 5-7. The support frame 100 supports the air compressor 20 and drive motor 30, and is generally adapted as a support structure that may be attached to a railway vehicle body 50, which is schematically shown in FIG. 4. Generally, the support frame 100 is formed by a plurality of tubular frame members 110 and a plurality of connecting brackets 120 connecting the tubular frame members 110 to form a three-dimensional structure. The connecting brackets 120 comprise individual flange elements 122 to accept respective ends 112 of the tubular frame members 110 to form the three-dimensional structure. The ends 112 of the tubular frame members 110 are swaged to the flange elements 122 of the connecting brackets 120. While swaging is described herein as a desirable attachment method for securing the ends 112 of the tubular frame members 110 to the flange elements 122, this attachment method should not be considered as exhaustive of possible attachment methods that may be used to secure the ends 112 of the tubular frame members 110 to the flange elements 122. As examples, mechanical fasteners, welding, and like techniques are suitable attachment methods for securing the ends 112 of the tubular frame members 110 to the flange elements 122.

The connecting brackets 120 are in the form of corner brackets to connect the tubular frame members 110 to form a rectangular-shaped three-dimensional structure. The corner connecting brackets 120 at a top side 102 of the rectangular-shaped three-dimensional structure defined by the support frame 100 may be adapted for connection to a railway vehicle body 50, which is schematically shown in FIG. 4. The corner connecting brackets 120 may comprise three (3) generally orthogonal flange elements 122 to connect three (3) tubular frame members 110 to form a corner 104 of the rectangular-shaped three-dimensional structure of the support frame 100. The flange elements 122 define receiving openings 124 for receiving the tubular frame members 110. In particular, the respective ends 112 of the tubular frame members 110 are swaged in place in the openings 124. The ends 112 of the tubular frame members 110 may be swaged to form end flanges 114 to secure the ends 112 in the openings 124. The open ends 112 of the tubular frame members 110 may be sealed with removable or permanently installed end caps 116. As an example, plastic end caps 116 may be installed in the open ends 112 of the tubular frame members 110 by a snap-fit or simple friction-fit connection.

The respective tubular frame members 110 comprise abutment flanges 126 provided on the opposite of the end flanges 114 and which are either formed prior to swaging the ends 112 of the tubular frame members 110 or are formed as a result of the swaging process. The swaged ends 112 of the tubular frame members 110 and the opposing abutment flanges 126 support the end flanges 114 such that the end flanges 114 are sandwiched between the swaged ends 112 and the abutment flanges 126. The corner connecting brackets 120 at a top side 102 of the rectangular-shaped three-dimensional structure defined by the support frame 100 may be formed with top flanges 130 that define openings or apertures 132 used to connect the support frame 100 to the body of a railway vehicle (not shown). However, as illustrated in the Figures, the top flanges 130 may be separate flange elements that are attached to the tubular frame members 110 forming or defining the top end 102 of the support frame 100. For example, the separately formed top flanges 130 may be affixed to corresponding flanges 134 provided on the railway vehicle body 50 to secure the modular support frame 100 to the railway vehicle body 50.

As a general manufacturing process, swaging may be broken up into two categories. The first category of swaging involves the workpiece being forced through a confining die to reduce its diameter, similar to the process of drawing wire. This may also be referred to as "tube swaging". The second category involves two or more dies used to hammer a round workpiece into a smaller diameter. This process is usually called "rotary swaging". Tubes may be reduced in diameter to enable the tube to be initially fed through the die to then be pulled from the other side using a rotary swager, which allows them to be drawn on a draw bench. A common use of swaging is to attach fittings to pipes or cables. During assembly the parts loosely fit together, and a mechanical or hydraulic tool compresses and deforms the fitting, creating a permanent joint.

In the present modular support frame 100, the support frame 100 is constructed by providing a plurality of tubular frame members 110. The ends 112 of the tubular frame members 110 are inserted into the receiving openings 124 in the flange elements 122 of the respective corner connecting brackets 120 to connect the tubular frame members 110 to one another using the plurality of corner connecting brackets 120. The tubular frame members 110 and connecting brackets 120 form a three-dimensional structure, such as the three-dimensional rectangular structure as shown. Once the ends 112 of the tubular frame members 110 are inserted into the receiving openings 124 in the flange elements 122 of the respective corner connecting brackets 120, the ends 112 may be swaged to form the end flanges 114 that resist removal of the ends 112 from the flange elements 122. As noted previously, the respective tubular frame members 110 have abutment flanges 126 provided on the opposite of the end flanges 114, which are either formed prior to swaging the ends 112 of the tubular frame members 110 or are formed as a result of the swaging process. The swaged ends 112 of the tubular frame members 110 and the opposing abutment flanges 126 support the end flanges 114 such that the end flanges 114 are sandwiched between the swaged ends 112 and the abutment flanges 126, as noted previously.

Figure 1:
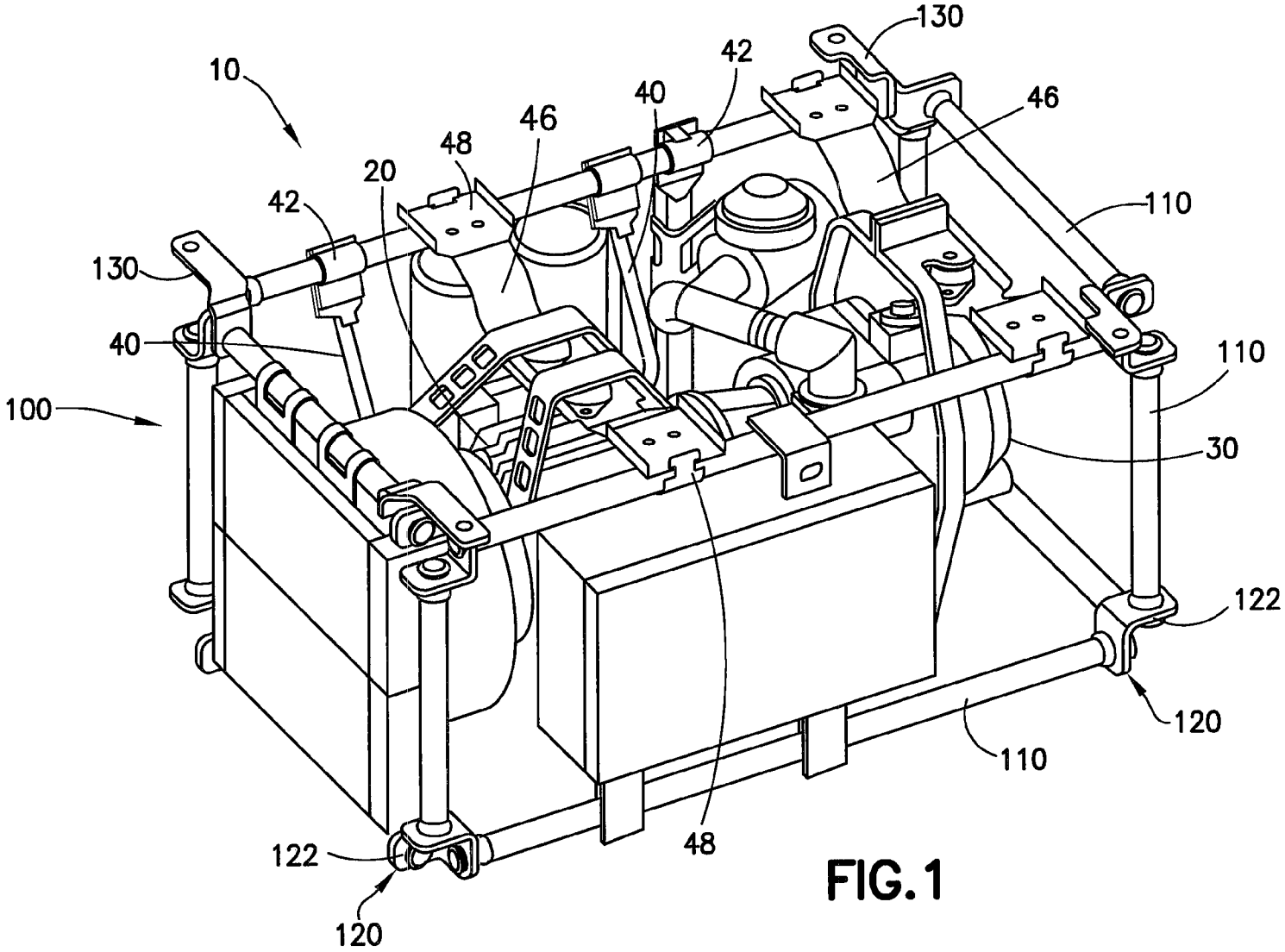
FIG. 1 is a perspective view of an air compressor and drive motor supported by a modular support frame according to one embodiment.
Figure 2:
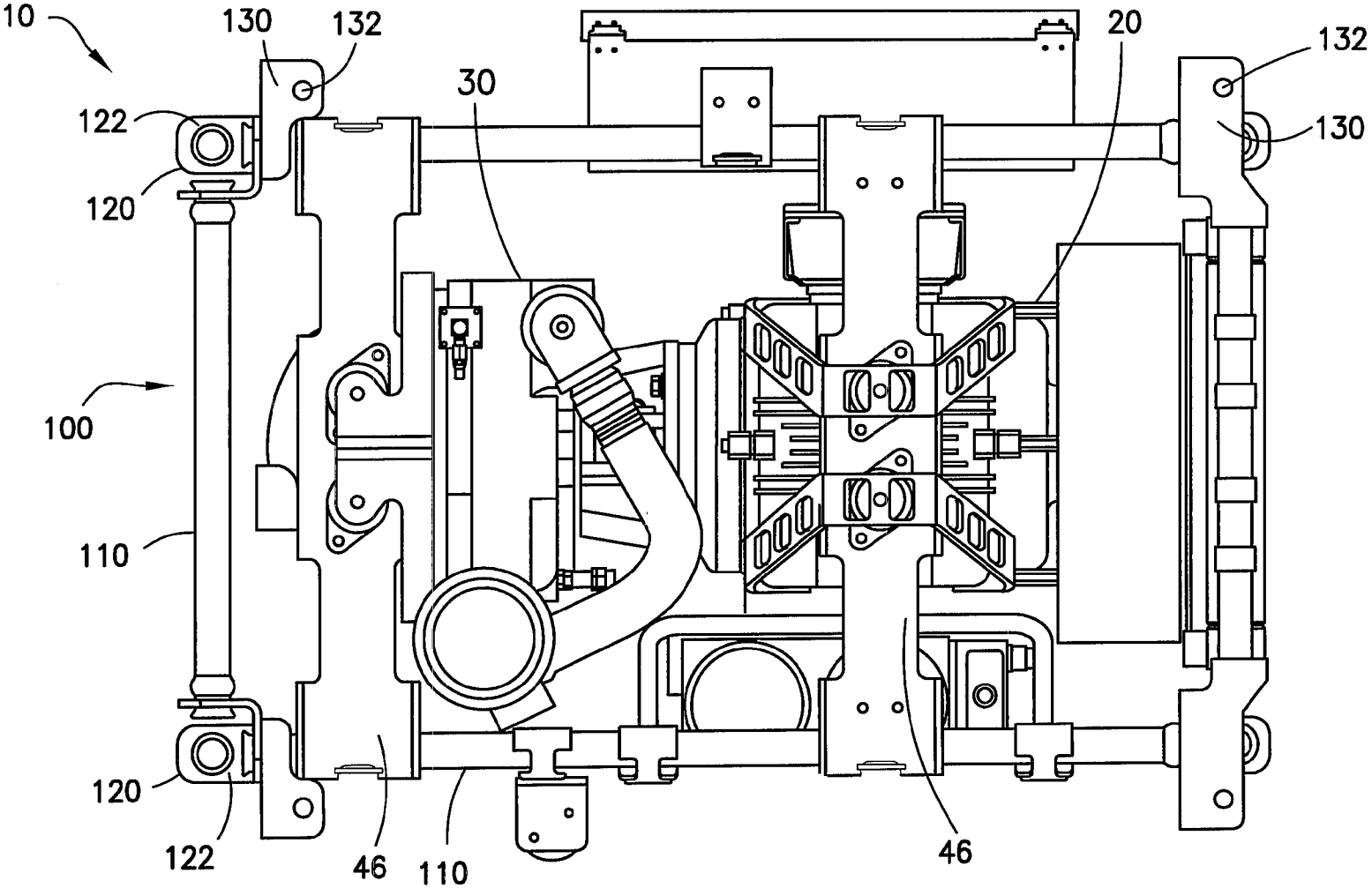
FIG. 2 is a plan view of the air compressor and drive motor supported by the modular support frame shown in FIG. 1.
Figure 3:
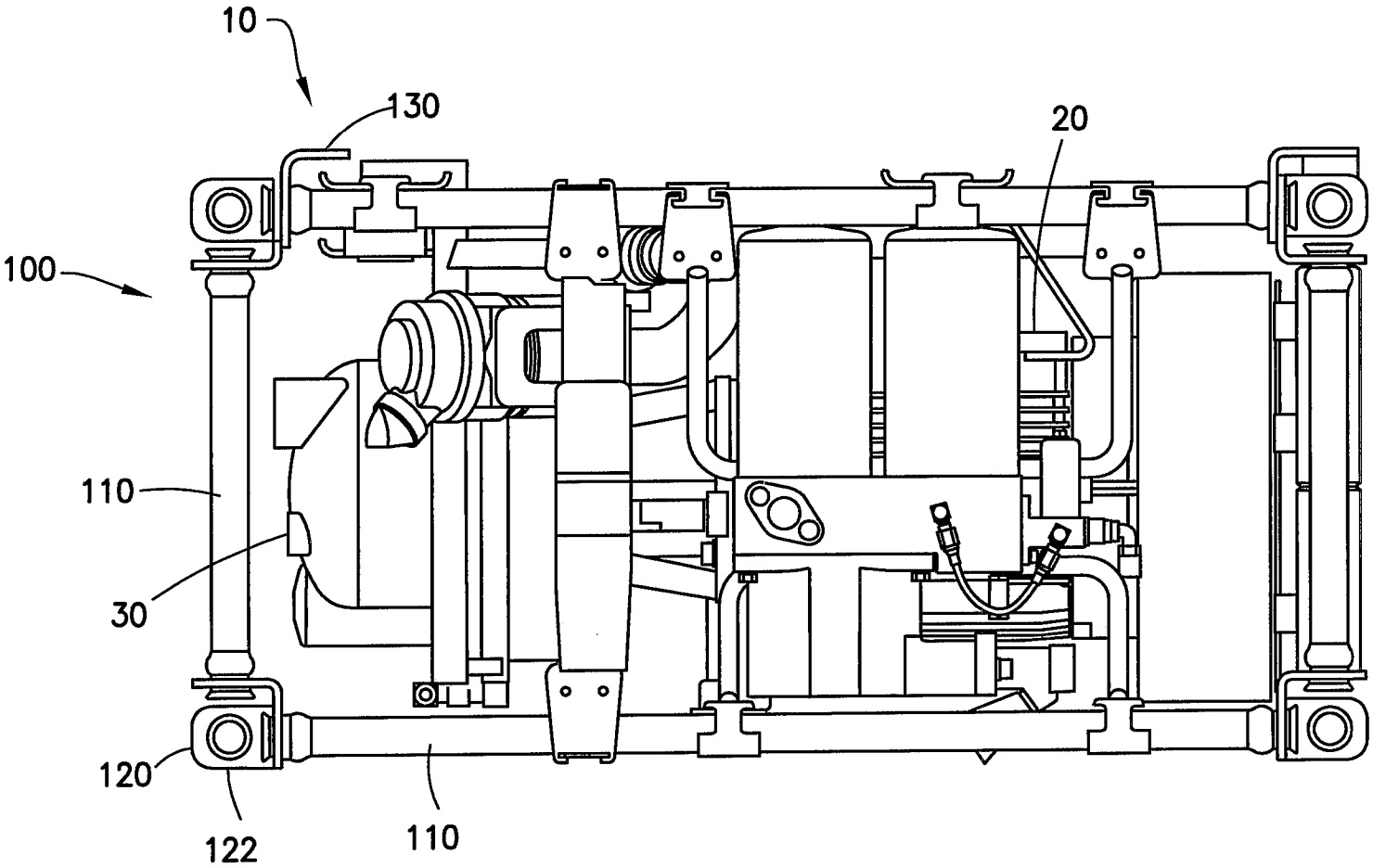
FIG. 3 is an elevation view of the air compressor and drive motor supported by the modular support frame shown in FIG. 1.

As shown best in FIG. 1, the air compressor 20 and drive motor 30 may be supported to the tubular frame members 110 using bracket elements or members 40 that have tubular shaped end pieces 42 that cooperate with the respective tubular frame members 110. Additionally, laterally-extending support members 46 may be secured to the air compressor 20 and drive motor 30. The support members 46 may likewise have tubular shaped end pieces 48 that cooperate with the respective tubular frame members 110 disposed at the top end of the support frame 100. The support members 46 may also be configured for connection to the body of a railway vehicle (not shown) and thereby the railway vehicle body may directly support some of the weight of the air compressor 20 and the drive motor 30 so not all of the weight of these elements is supported by the support frame 100. Once the air compressor 20 and the drive motor 30 are secured to the support frame 100, the assembled or module support frame 100 may be lifted as one assembly and secured via the top flanges 130 and the foregoing laterally-extending support members 46 to the body of a railway vehicle (not shown). The tubular shaped end pieces 42 that cooperate with the respective tubular frame members 110 are advantageous because, for example, the integrity of the tubular frame members 110 is maintained and holes are not formed in the tubular members 110 for mechanical fasteners used to secure the bracket elements or members 40 to the tubular frame members 110. Such "drill" holes can provide an access route for moisture that could corrode the interior of the tubular members 110. The use of the tubular shaped end pieces 42 overcomes this disadvantage.

Figure 8:
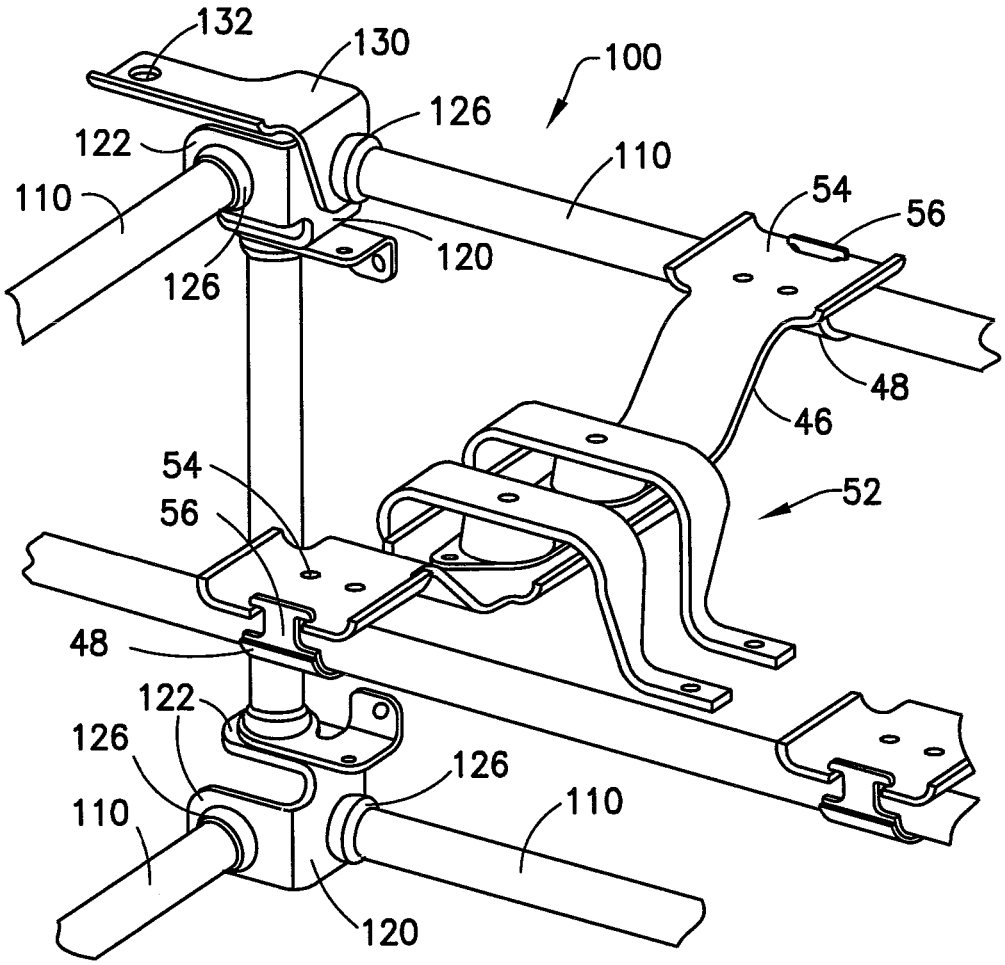
FIG. 8 is a perspective view of an upper portion of the modular support frame shown in FIG. 1.

As shown in FIG. 8, with respect to the support member 46 discussed previously, these members 46 may have a center section 52 that is specifically adapted to support the mechanical equipment, such as the air compressor 20 or drive motor 30. This support member 46 may have plate ends 54 that can be cut so that the support member 46 has an appropriate length to extend between the tubular frame members 110 disposed at the top side 102 of the rectangular-shaped three-dimensional structure defined by the support frame 100. The plate ends 54 may be secured to the tubular frame members 110 using the tubular shaped end pieces 48, discussed previously, using a strap connector 56 and like connector elements.

While embodiments of a support frame for supporting mechanical elements or devices to railway vehicles and like vehicles and methods of assembly thereof were provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A support frame for supporting mechanical equipment to a railway vehicle body, comprising:

a plurality of tubular frame members; and a plurality of connecting brackets connecting the tubular frame members to form a three-dimensional structure, the connecting brackets comprising flange elements to accept respective ends of the tubular frame members to form the three-dimensional structure;

wherein each tubular frame member comprises at least one swaged abutment flange and at least one swaged end flange;

wherein each abutment flange comprises a hollow portion; and wherein each end flange is tapered;

wherein the flange elements are disposed between at least one abutment flange and at least one end flange, such that the ends of the tubular frame members are swaged to the flange elements of the connecting brackets such that no mechanical fastener or welding is used;

wherein the flange elements define receiving openings for the tubular frame members and the ends of the tubular frame members are swaged in place in the openings to form the end flanges; and wherein the connecting brackets comprise corner brackets, the corner brackets comprising at least three individual and generally orthogonal flange elements formed such that an upstanding flange element in each corner bracket is connected to two other flange elements and the two other flange elements are connected to only one other flange element.

2. A support frame as claimed in claim 1, wherein the corner brackets connect the tubular frame members to form a rectangular-shaped three-dimensional structure.

3. A support frame as claimed in claim 2, wherein the corner brackets at a top side of the rectangular-shaped three-dimensional structure are adapted for connection to a railway vehicle body.

4. A support frame as claimed in claim 2, wherein the at least three individual and generally orthogonal flange elements connect three tubular frame members to form a corner of the rectangular-shaped three-dimensional structure.

5. A modular support frame assembly for attachment to a railway vehicle body, comprising:

a support frame comprising:

a plurality of tubular frame members;

a plurality of connecting brackets connecting the tubular frame members to form a three-dimensional structure, the connecting brackets comprising flange elements to accept respective ends of the tubular frame members to form the three-dimensional structure; and wherein each tubular frame member comprises at least one swaged abutment flange and at least one swaged end flange;

wherein each abutment flange comprises a hollow portion; and wherein each end flange is tapered;

wherein the flange elements are disposed between at least one abutment flange and at least one end flange, such that the ends of the tubular frame members are swaged to the flange elements of the connecting brackets such that no mechanical fastener or welding is used;

wherein the flange elements define receiving openings for the tubular frame members and the ends of the tubular frame members are swaged in place in the openings to form the end flanges; and wherein the connecting brackets comprise corner brackets, the corner brackets comprising at least three individual and generally orthogonal flange elements formed such that an upstanding flange element in each corner bracket is connected to two other flange elements and the two other flange elements are connected to only one other flange element; and a mechanical device supported by the tubular frame members.

6. A modular support frame assembly as claimed in claim 5, wherein the corner brackets connect the tubular frame members to form a rectangular-shaped three-dimensional structure.

7. A modular support frame assembly as claimed in claim 6, wherein the corner brackets at a top side of the rectangular-shaped three-dimensional structure are adapted for connection to a railway vehicle body.

8. A modular support frame assembly as claimed in claim 7, wherein the at least three individual and generally orthogonal flange elements connect three tubular frame members to form a corner of the rectangular-shaped three-dimensional structure.

9. A modular support frame assembly as claimed in claim 5, wherein the mechanical device comprises an air compressor driven by a driving motor.

10. A method of forming a modular support frame assembly, comprising:

providing a plurality of tubular frame members;

connecting the tubular frame members to one another using a plurality of connecting brackets such that the tubular frame members form a three-dimensional structure, the connecting brackets comprising flange elements adapted to accept respective ends of the tubular frame members to form the three-dimensional structure;

connecting the respective ends of the tubular frame members to the flange elements; and swaging the ends of the tubular frame members to form at least one abutment flange and at least one end flange;

wherein each abutment flange comprises a hollow portion; and wherein each end flange is tapered;

disposing the flange elements between at least one abutment flange and at least one end flange, such that the ends of the tubular frame members are swaged to the flange elements of the connecting brackets such that no mechanical fastener or welding is used;

wherein the flange elements define receiving openings for the tubular frame members, and further comprising swaging the ends of the tubular frame members in place in the openings to form the end flanges; and wherein the connecting brackets comprise corner brackets, the corner brackets comprising at least three individual and generally orthogonal flange elements formed such that an upstanding flange element in each corner bracket is connected to two other flange elements and the two other flange elements are connected to only one other flange element.

11. A method as claimed in claim 10, further comprising supporting a mechanical device between the tubular frame members.

12. A method as claimed in claim 11, wherein the mechanical device comprises an air compressor driven by a driving motor.

13. A method as claimed in claim 10, wherein the corner brackets connect the tubular frame members to form a rectangular-shaped three-dimensional structure.

14. A method as claimed in claim 13, wherein the corner brackets at a top side of the rectangular-shaped three-dimensional structure are adapted for connection to a railway vehicle body.

15. A method as claimed in claim 13, wherein the at least three individual and generally orthogonal flange elements connect three tubular frame members to form a corner of the rectangular-shaped three-dimensional structure.

* * * * *